US007878638B2

(12) United States Patent
Akase et al.

(10) Patent No.: US 7,878,638 B2
(45) Date of Patent: Feb. 1, 2011

(54) LIQUID EJECTING HEAD

(75) Inventors: Takashi Akase, Azumino (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 773 days.

(21) Appl. No.: 11/854,334

(22) Filed: Sep. 12, 2007

(65) Prior Publication Data

US 2008/0062233 A1 Mar. 13, 2008

(30) Foreign Application Priority Data

Sep. 13, 2006 (JP) ..... 2006-247662

(51) Int. Cl.
*B41J 2/19* (2006.01)
*B41J 2/175* (2006.01)

(52) U.S. Cl. ..... 347/92; 347/93

(58) Field of Classification Search ..... 347/65, 347/66, 92, 93
See application file for complete search history.

(56) References Cited

U.S. PATENT DOCUMENTS 5,495,272 A * 2/1996 Yamaguchi ..... 347/28
6,019,465 A * 2/2000 Shinada et al. ..... 347/93
6,190,009 B1 * 2/2001 Kitahara ..... 347/93
6,634,742 B2 * 10/2003 Owaki et al. ..... 347/93
6,814,435 B1 * 11/2004 Shimada et al. ..... 347/93

FOREIGN PATENT DOCUMENTS

| | | |
|---|---|---|
| JP | 11-078046 | 3/1999 |
| JP | 11-277751 | 10/1999 |
| JP | 2006-095972 | 4/2006 |
| JP | 2006-224313 | 8/2006 |
| JP | 2006-224567 | 8/2006 |

* cited by examiner

*Primary Examiner*—Anh T. N. Vo
(74) *Attorney, Agent, or Firm*—Workman Nydegger

(57) ABSTRACT

The invention provides a liquid ejecting head which is capable of introducing liquid from a liquid storage member to a pressure chamber through a liquid flow channel and discharging the liquid in the pressure chamber from a nozzle opening as liquid drops by an operation of pressure generating means including: a filter chamber in the middle of the liquid flow channel, the filter chamber having a diameter larger than other portions of the liquid flow channel and having a filter disposed therein for filtering the liquid in the liquid flow channel, wherein the filter chamber includes a liquid repellent area having a static contract angle with respect to liquid larger than that of the inner wall on the downstream side of the filter formed on the inner wall in the vicinity of the filter on the upstream side thereof.

11 Claims, 6 Drawing Sheets

LIQUID EJECTING HEAD

BACKGROUND

1. Technical Field

The present invention relates to a liquid ejecting head such as ink jet type recording head and, more specifically, to a liquid ejecting head in which liquid stored in a liquid storing member is introduced into pressure chambers via liquid flow channels, and the liquid introduced into the pressure chambers is discharged as ink drops from nozzle openings.

2. Related Art

Examples of liquid ejecting head for discharging liquid in pressure chambers as liquid drops from nozzle openings by causing pressure variation therein includes an ink jet type recording head (hereinafter, referred to simply as "recording head") used in an image recording apparatus such as an ink jet type recording apparatus (hereinafter, referred to simply as "printer"), a color material ejecting head used for manufacturing color filters of liquid crystal display or the like, an electrode material ejecting head used for forming electrodes, for example, in an organic EL (Electro Luminescence) display and an FED (surface emission type display), and a biological organic substance ejecting head used for manufacturing biochips.

For example, in the above-described recording head, ink in an ink cartridge is introduced to the pressure chamber side of the recording head through introduction holes opened on the distal end sides of ink introduction needles by inserting the ink introducing needles, which are a kind of liquid introduction needle, into the ink cartridge as a liquid storage member including ink in liquid state sealed therein. There is proposed a configuration in which the ink cartridge arranged on a main body of the printer and the ink introducing needles of the recording head are connected with ink tubes, so that the ink in the ink cartridge is fed into the recording head with a pump or the like.

An ideal state in the recording head in the configuration described above is such that ink flow channels (liquid flow channels) extending from the ink introduction needles to the nozzle openings of the recording head are filled with ink. However, it is difficult to avoid entry of air bubbles into the ink flow channels completely when, for example, filling ink into the recording head (initial filling). The air bubbles entered into the ink flow channels are grown to large sizes with time, and hence when the excessively grown air bubbles pass through filters in the filter chambers arranged partway in the ink flow channels and move to the pressure chamber side by the ink flow, defects such as pressure loss due to the air bubbles absorbing the pressure variation during discharging operation, or ink supply shortage due to the air bubbles clogging the flow channels may be resulted.

In order to prevent such defects due to the air bubbles, there is proposed a method of increasing an air bubble expellant efficiency so as to prevent air bubbles from staying in the ink flow channel as much as possible. For example, a configuration in which air bubble introducing grooves are provided on the inner peripheral surfaces of the ink introducing needles in the vicinity of the filter (filter mounting member) so that the air bubbles in the ink flow channels are guided to the downstream side positively by these air bubble introducing grooves (See JP-A-11-078046).

However, In a configuration in the related art, when the air bubbles are grown to large sizes in the interior (filter chamber) of the ink introduction needle, even though cleaning operation for expelling the ink or air bubbles is performed, the ink passes between an inner wall of the filter chamber and the air bubbles easily, the air bubbles cannot be expelled sufficiently, and the remaining air bubbles are grown to large sizes immediately. Therefore, there is a problem such that the cleaning operation needs to be performed frequently, and hence ink is consumed uselessly.

SUMMARY

An advantage of some aspects of the invention is to provide a liquid ejecting head in which the air bubble expellant efficiency in the filter chambers is improved so that the amount of consumption of liquid is restrained by reducing the number of times of cleaning operation.

In order to achieve the above-described object, according to an aspect of the invention, there is provided a liquid ejecting head which is capable of introducing liquid from a liquid storage member to a pressure chamber through a liquid flow channel and discharging the liquid in the pressure chamber from a nozzle opening as liquid drops by an operation of pressure generating means, including: a filter chamber in the middle of the liquid flow channel, the filter chamber having a diameter larger than other portions of the liquid flow channel and having a filter disposed therein for filtering the liquid in the liquid flow channel, wherein the filter chamber includes a liquid repellent area having a static contact angle with respect to liquid larger than that of the inner wall on the downstream side of the filter formed in the vicinity of the filter on the inner wall on the upstream side thereof.

According to the configuration described above, the filter chamber is formed on the inner wall thereof on the upstream side of the filter with the liquid repellent area having a larger static contact angle with respect to the liquid than that of the inner wall thereof on the downstream side of the filter in the vicinity of the filter. Therefore, the air bubbles in the filter chamber is forced to be adhered to the liquid repellent area during a cleaning operation for forcedly repelling the liquid or the air bubbles in the liquid flow channel from the nozzle opening. Therefore, the liquid can hardly pass through the area between the inner wall of the filter chamber and the air bubbles, and the air bubbles cover the upper surface of the filter, so that the liquid flow channel is closed temporarily. Consequently, a pressure difference between the upstream side and the downstream side of the air bubbles is achieved, and hence the one cleaning operation achieves not only repellent of a larger amount of air bubbles than in the related art, but also reduction of amount of ink consumption.

That is, the one cleaning operation achieves repellent of a larger amount of air bubbles than in the related art, the amount of the remaining air bubbles staying in the filter chamber when the cleaning operation is ended may be reduced in comparison with the related art. That is, a period needed for the remaining air bubbles in the filter chamber to reach an allowable air bubble amount which may cause a problem may be significantly elongated in comparison with the related art. Consequently, the frequency of execution of the cleaning operation may be reduced. Accordingly, the consumption of liquid in association with the cleaning operation can further be restrained.

Preferably, the inner wall of the filter chamber on the upstream side of the filter is divided into the liquid repellent area formed in the vicinity of the filter and a non-liquid-repellent area being arranged on the upstream side of the liquid repellent area and having a static contact angle with respect to liquid smaller than that of the liquid repellent area.

In this arrangement, the inner wall of the filter chamber on the upstream side of the filter is divided into the liquid repellent area formed in the vicinity of the filter and the non-liquid-repellent area being arranged on the upstream side of the liquid repellent area and having a static contact angle with respect to liquid is smaller than that of the liquid repellent area. Therefore, the air bubbles are liable to be adhered only to the portion in the vicinity of the filter, while the air bubbles are prevented from being adhered to the inner wall of the filter chamber far apart from the filter, so that increase in the amount of remaining air bubbles in the filter chamber is prevented. Therefore, the period which is needed for the amount of the remaining air bubbles to reach the allowable air bubble amount is prevented from being shorter, so that the increase of the frequency of execution of the cleaning operation is prevented.

Preferably, the filter chamber is a filter chamber formed on the upstream side of the pressure chamber at the closest position to the pressure chamber.

Preferably, a liquid introducing needle for introducing liquid from the liquid storage member through a liquid introduction hole into the liquid flow channel is provided, and the filter chamber is formed in the liquid flow channel adjacent to the liquid introduction needle on the downstream side.

Preferably, the filter chamber is a filter chamber having the smallest capacity from among a plurality of the filter chambers formed in the same liquid flow channel.

Preferably, the filter chamber corresponds to all the filter chambers formed in the liquid flow channel.

Preferably, the filter in the filter chamber is capable of removing foreign substances having a maximum external size of 5 to 16 μm from the liquid in the liquid flow channel.

In this configuration, not only reduction of the flow channel resistance of the filter but also enhancement of the expellant efficiency of the air bubbles staying in the filter chamber.

Preferably, the liquid repellent area is formed by applying liquid repellent agency.

Preferably, the liquid repellent area is formed by film formation.

Preferably, the liquid repellent area is formed by vapor deposition.

Preferably, the liquid repellent area is formed by using liquid repellent material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring now to the attached drawings, a best mode for carrying out the invention will be described below. According to the embodiments shown below, various definitions are given as preferred embodiments of the invention. However, the scope of the invention is not limited to the description given below unless otherwise specifically mentioned as that the invention is limited to the description. According to the embodiments shown below, an ink jet type recording head (hereinafter, referred to as "recording head") is described as an example of the liquid ejecting head.

Figure 1:
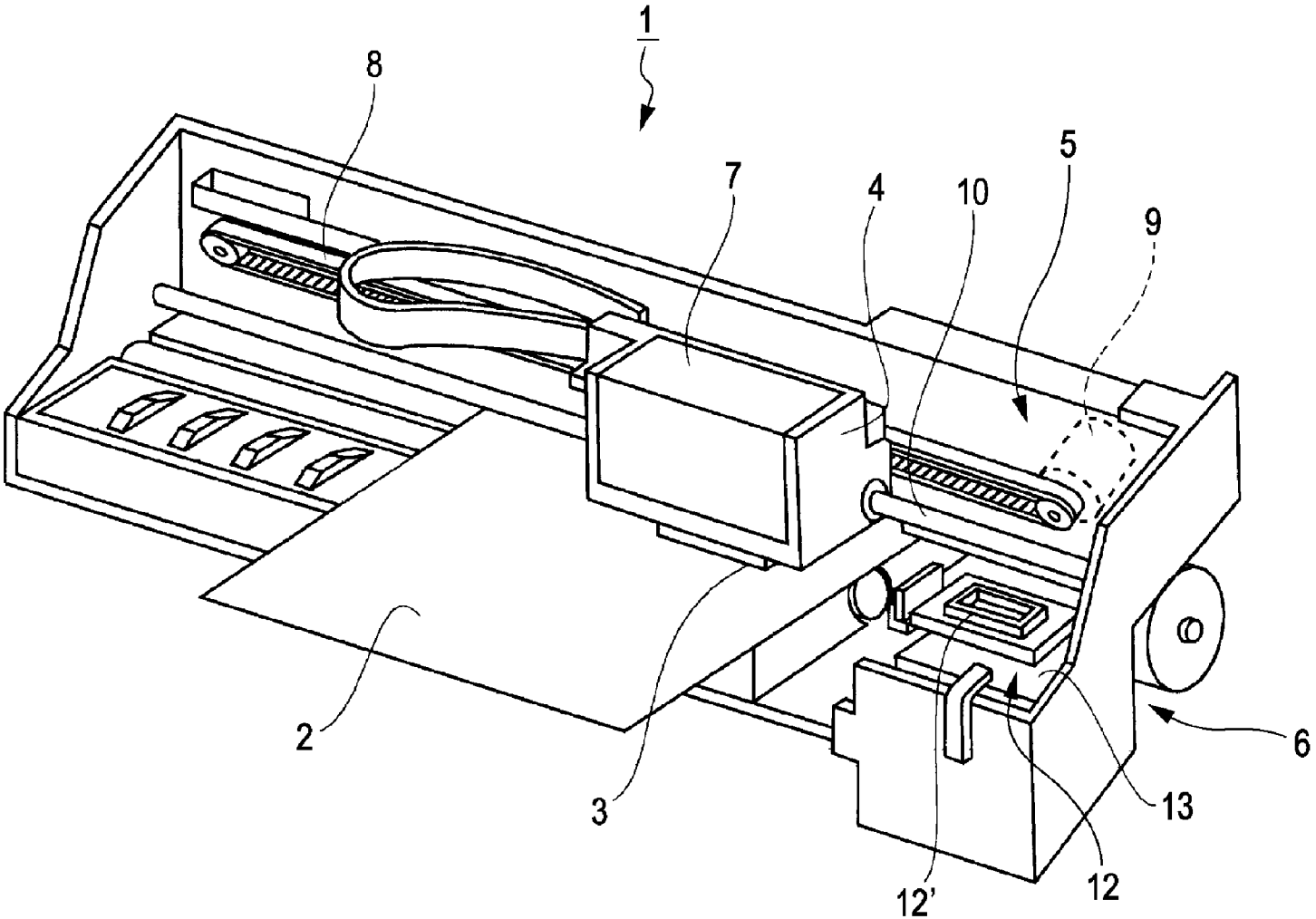
FIG. 1 is an explanatory perspective view illustrating a configuration of a printer.

Referring now to FIG. 1, a general configuration of an ink jet type recording apparatus in which the recording head is mounted (a kind of liquid ejecting apparatus, hereinafter, referred to as "printer"). An exemplified printer 1 is an apparatus that records images or the like by discharging ink in a liquid state onto the surface of a recording medium (object of discharge) 2 such as recording paper. The printer 1 includes a recording head 3, a carriage 4 to which the recording head 3 is mounted, a carriage transfer mechanism 5 that causes the carriage 4 to reciprocate in a primary scanning direction, and a paper feeding mechanism 6 that transports the recording medium 2 in a secondary scanning direction (a direction orthogonal to the primary scanning direction) of a recording medium 2. The ink described above is a type of liquid according to embodiments of the invention, and is stored in an ink cartridge 7 (a kind of liquid storage member). The ink cartridge 7 is demountably mounted to the recording head 3.

The carriage transfer mechanism 5 includes a timing belt 8. The timing belt 8 is driven by a pulse motor 9 such as a DC motor. Therefore, when the pulse motor 9 is activated, the carriage 4 is guided by a guide rod 10 provided in the printer 1 and reciprocates in the primary scanning direction (the widthwise direction of the recording medium 2).

A capping mechanism 12 is disposed at a home position, which is a non-printed area, of the printer 1. The capping mechanism 12 includes a cap member 12' in a shape of a tray which is able to abut against a nozzle formed surface of the recording head 3. In this capping mechanism 12, a space in the cap member 12' serves as a sealing space, and is configured to be capable of coming into tight contact with the nozzle formed surface in a state in which nozzle openings 14 (see FIG. 5) of the recording head 3 are exposed to the sealing space. The capping mechanism 12 includes a pump unit 13 connected thereto, and the interior of the sealing space may be depressurized by the operation of the pump unit 13. When the pump unit 13 is activated in a state of tight contact with the nozzle formed surface and the sealing spacer (sealed space) is depressurized, ink or air bubbles in the recording head 3 is sucked through the nozzle openings 14, and is expelled into the sealed space of the cap member 12'. That is, the capping mechanism 12 has a configuration in which the cleaning operation such as to forcedly suck and expel the ink or air bubbles in the recording head 3 (in the ink supply channels). The cleaning operation will be described later.

Figure 2:
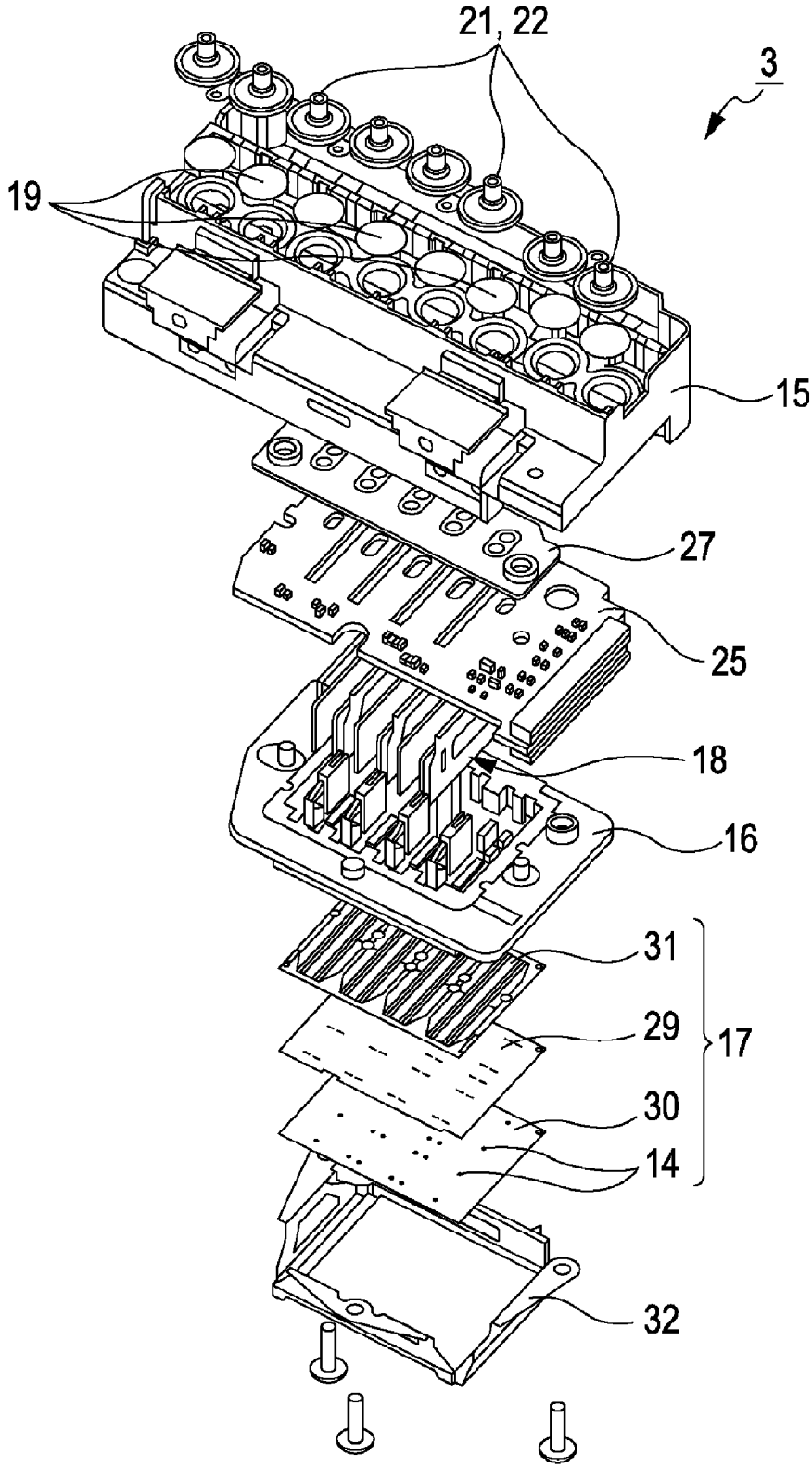
FIG. 2 is an explanatory exploded perspective view illustrating a configuration of a recording head.
Figure 3:
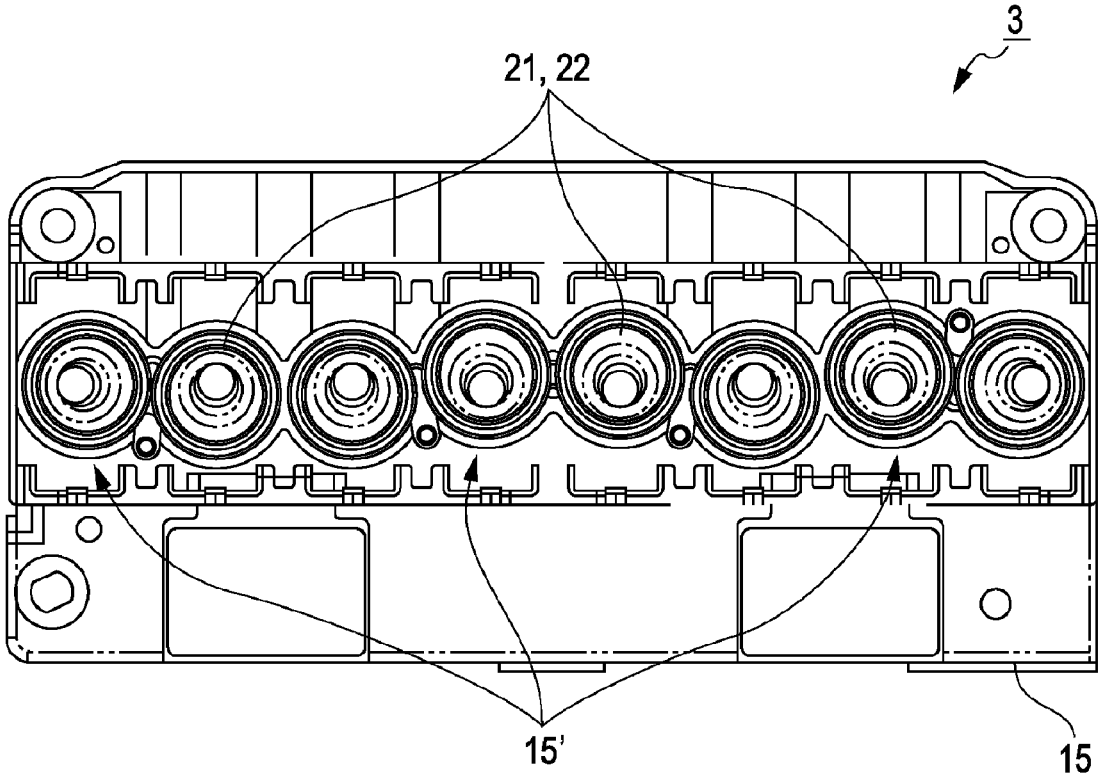
FIG. 3 is an explanatory plan view illustrating a configuration of the recording head.
Figure 4:
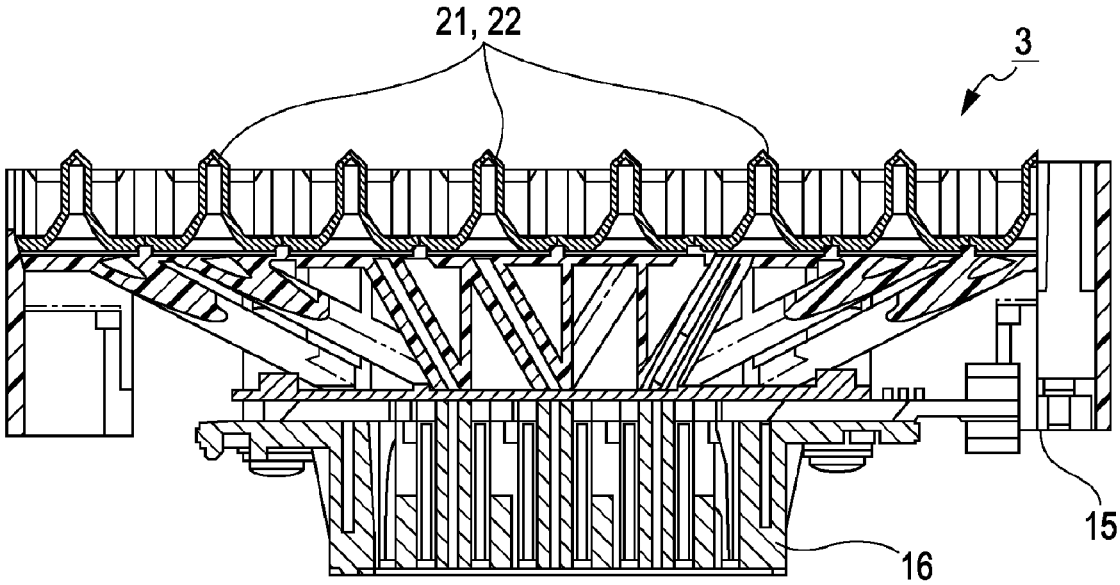
FIG. 4 is an explanatory cross section illustrating an internal structure of the recording head.
Figure 5:
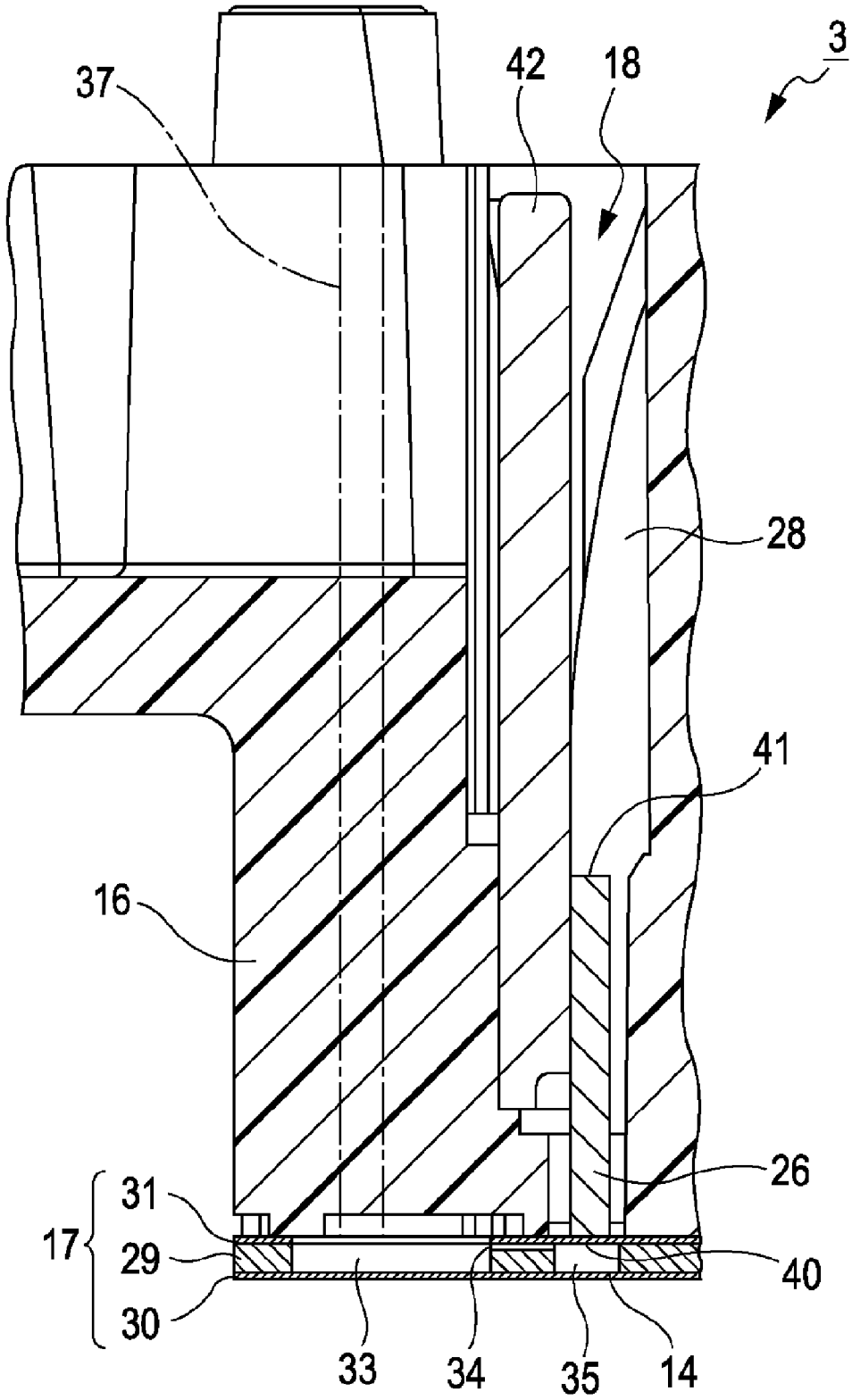
FIG. 5 is an explanatory partial cross section illustrating the internal structure of the recording head.

The configuration of the recording head 3 will be described. FIG. 2 is a schematic perspective view of the recording head 3; FIG. 3 is a plan view of the recording head 3; FIG. 4 is a cross-sectional view of the recording head 3; and FIG. 5 is a cross-sectional view of a principal portion of the recording head. The recording head 3 in this embodiment includes an introduction needle unit 15, a head case 16, a flow channel unit 17, and a vibrator unit 18.

The introduction needle unit 15 is, for example, formed of resin material, and as shown in FIG. 3, a plurality of cartridge mounting units 15' are provided on the upper surface thereof. The respective cartridge mounting units 15' each include a filter chamber 20 having a filter 19 in the interior thereof, and an ink needle body 22 composed of an ink introduction needle 21 (which corresponds to a liquid introduction needle in the invention) formed continuously on the upper (upstream) side of the filter chamber 20 so that the distal end projects upward. The cartridge mounting unit 15' accommodates the ink cartridge 7 with various colors of ink stored therein. When the ink cartridge 7 is mounted to the cartridge mounting unit 15', the ink introduction needle 21 is inserted into the ink cartridge 7. Accordingly, the ink storage space in the interior of the cartridge and the ink flow channel in the interior of the recording head 3 communicate with each other via an ink introduction hole 24 (see FIG. 6) opened at a tip 23 of the ink introduction needle 21, and ink stored in the interior of the cartridge is introduced into the recording head 3 through the ink introduction hole 24. The ink cartridge 7 is not limited to a type to be mounted to the carriage 4 as in this embodiment, and may be a type which is mounted to the casing side of the printer 1 so that ink is supplied to the recording head 3 side via the ink supply tube.

Mounted between the lower surface of the introduction needle unit 15, which is on the opposite side form the cartridge mounting unit 15', and the upper surface of the head case 16 is a circuit substrate 25, as shown in FIG. 2. The circuit substrate 25 includes a circuit pattern for supplying drive signals, for example, to a piezoelectric vibrator 26 (see FIG. 5) and a connector for the connection with the main body of the printer 1. The circuit substrate 25 is mounted to the introduction needle unit 15 via a seat member 27 which serves as a packing.

The head case 16 is a member in the shape of hollow box for storing the vibrator unit 18 having the piezoelectric vibrator 26. In the interior of the head case 16 is formed with a storage space 28 which is capable of accommodating the vibrator unit 18 (see FIG. 5). The vibrator unit 18 is stored in the storage space 28, and is fixed to the inner wall surface of the storage space 28 via adhesion or the like. On the distal end surface of the head case 16 opposite from the mounting surface of the introduction needle unit 15 is provided with the flow channel unit 17 fixed with adhesive agent or the like. The flow channel unit 17 is fabricated by arranging a nozzle plate 30 on one side of a flow-channel-formed substrate 29 and a vibration panel 31 on the other side thereof on the opposite side from the nozzle plate 30 with the intermediary of the flow-channel-formed substrate 29, and laminating and bonding these members with the adhesive agent or the like into a unit.

The nozzle plate 30 is a member fabricated from, for example, a thin stainless steel plate, and the nozzle plate 30 is formed with the minute nozzle openings 14 at pitches corresponding to the dot formation density of the printer 1. A head cover 32 is fabricated from, for example, a thin metal member, and is mounted to the distal end portion of the head case 16 from the outside of the nozzle plate 30 so as to surround the peripheral edge thereof. The head cover 32 has a function to protect the flow channel unit 17 and the distal end portion of the head case 16 and prevent static electrification of the nozzle plate 30.

The flow-channel-formed substrate 29 to be bonded to the nozzle plate 30 is a plate-shaped member including a plurality of spaces which serve as common ink chambers 33, groove portions which serve as ink supply ports 34, and spaces which serve as pressure cambers 35 partitioned by partitioning walls so as to correspond to the respective nozzle openings 14. The flow-channel-formed substrate 29 is fabricated, for example, by etching a silicone wafer. The pressure chambers 35 are each formed into a chamber elongated in the direction orthogonal to the direction of rows of the nozzle openings 14 (the direction of rows of the nozzles). The common ink chamber 33 communicates with an ink introduction channel 38 (a kind of flow channel: an introduction needle body 22 side ink flow channel, see FIG. 5 and FIG. 6) of the introduction needle body 22 via a head flow channel 37 (a kind of liquid flow channel: a head-side ink flow channel) formed through the head case 16 in the height direction, and to which ink stored in the ink cartridge 7 is introduced. Then, the ink introduced into the common ink chamber 33 is supplied to the respective pressure chambers 35 via the ink supply ports 34.

The vibration panel 31 to be bonded to the flow-channel-formed substrate 29 on the surface opposite from the nozzle plate 30 is a composite plate having a double structure formed by laminating a resilient film on a supporting plate formed of metal such as stainless steel. The vibration panel 31 is formed at positions corresponding to the pressure chambers 35 with island portions 40 for bonding distal ends of free end portions of the piezoelectric vibrators 26, which serve as diaphragm portions. The vibration panel 31 seals one of opening surfaces of the spaces which correspond to the common ink chambers 33 so as to serve as a compliance portion. The portion which serves as the compliance portion is the resilient film only.

The vibrator unit 18 includes a piezoelectric vibrator a piezoelectric vibrator group 41 which serves as pressure generating means, a fixing panel 42 to which the piezoelectric vibrator group 41 is bonded, and a flexible cable (not shown) for supplying drive signals from the circuit substrate 25 to the piezoelectric vibrator group 41, as shown in FIG. 5. The piezoelectric vibrator group 41 in this embodiment includes a plurality of piezoelectric vibrators 26 arranged in rows like a comb teeth. The piezoelectric vibrators 26 each include a fixed end portion thereof bonded onto the fixing panel 42, and a free end portion projecting outward from the distal end surface of the fixing panel 42. That is, the piezoelectric vibrator 26 is mounted onto the fixing panel 42 in a state of so-called cantilever. The fixing panel 42 which supports the piezoelectric vibrator 26 is formed of, for example, a stainless steel having a thickness of about 1 mm. The pressure generating means which may be employed includes an electrostatic actuator, a magnetostrictive element, and a heat generating element in addition to the piezoelectric vibrator.

The recording head 3 is configured in such a manner that when the piezoelectric vibrators 26 are expanded and contracted in the longitudinal direction, the island portions 40 move in the direction toward and away from the pressure chambers 35. Accordingly, the capacity of the pressure chambers 35 varies, and hence the pressure applied to the ink in the pressure chambers 35 varies. The pressure variation causes ink drops (a kind of ink drop) to be expelled from the nozzle openings 14.

Subsequently, the configuration of the introduction needle body 22 will be described.

Figure 6:
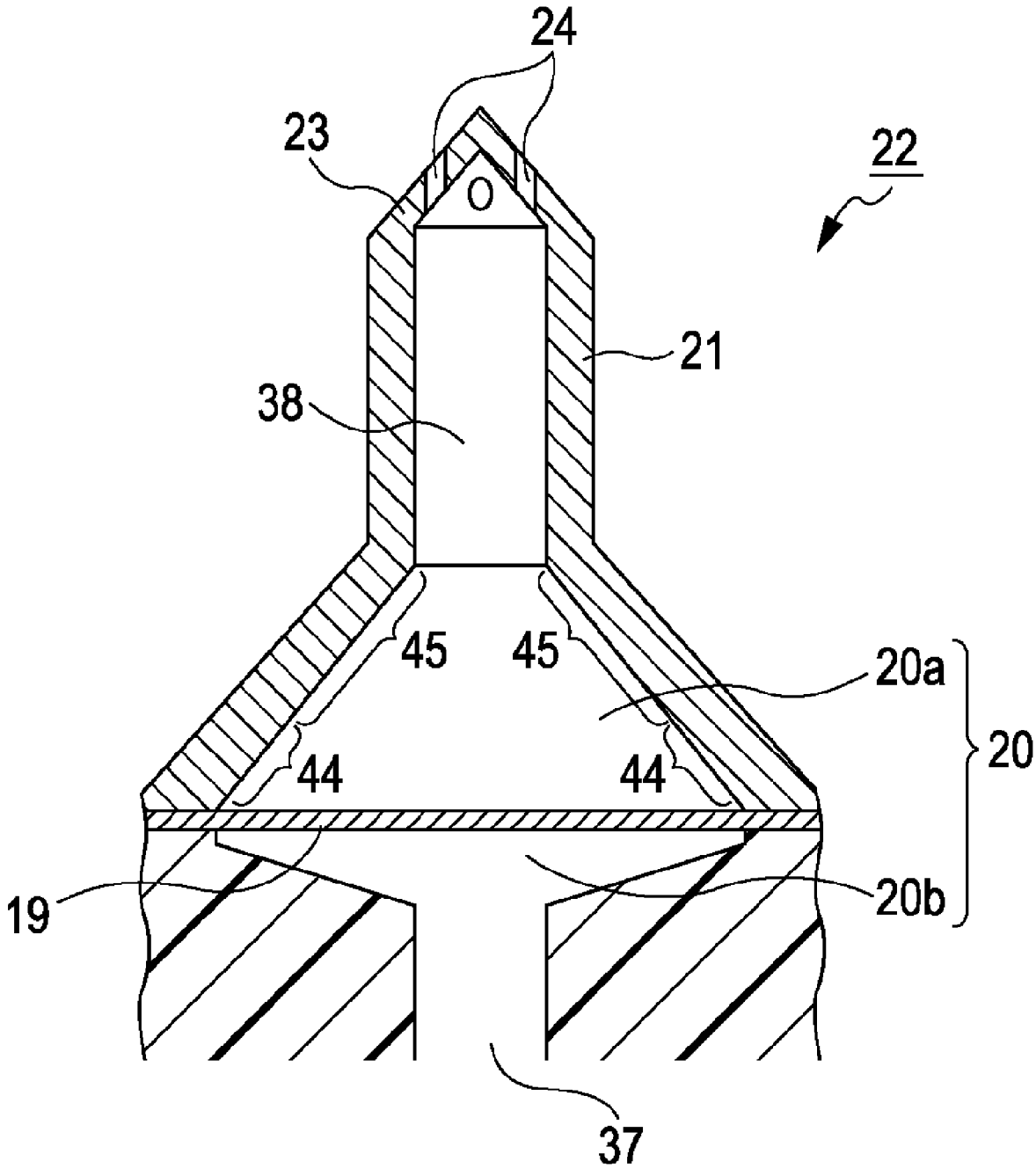
FIG. 6 is an explanatory cross section illustrating a configuration of an introduction needle body.

FIG. 6 is a cross-sectional view showing the configuration of the introduction needle body 22 taken along a longitudinal direction of a needle according to the embodiment. FIGS. 7A to 7D are schematic drawings for explaining the cleaning operation for expelling the air bubbles in the filter chamber 20. The introduction needle body 22 is a member of a hollow needle shape having an internal space which serves as the ink introduction channel 38 (a kind of a liquid flow channel) and is configured schematically by the ink introduction needle 21 and the filter chamber 20 formed continuously from the lower end (downstream side of the ink introduction channel 38) of the ink introduction needle 21, and the filter chamber 20 has a larger diameter than other portions of the ink flow channel (liquid flow channel).

The ink introduction needle 21 is a member of a hollow cylindrical shape which is to be inserted into the ink cartridge 7, and is formed with the conical tip 23 in a tapered shape at the distal end portion thereof. The tip 23 includes a plurality of the ink introduction holes 24 which communicate the outside the ink introduction needle 21 and the ink introduction channel 38. That is, as described above, when the ink introduction needle 21 is inserted into the interior of the ink cartridge 7, the ink in the cartridge is introduced into the ink introduction channel 38 through the ink introduction holes 24. In this embodiment, the configuration in which the ink introduction holes 24 are opened at the tips 23 is described as an example. However, a configuration in which the ink introduction holes 24 are opened on the side surface of the ink introduction needle 21 on the downstream side of the tip 23 is also applicable as another example.

As shown in FIG. 6, the filter chamber 20 is formed adjacently to the ink introduction channel 38 in the ink introduction needle 21 on the downstream side thereof with the intermediary of the disc-shaped filter 19 partway thereof, and includes an upper filter chamber 20*a* positioned upstream side of the filter 19 and gradually increased in diameter from the upstream (upper end opening) side toward the downstream side and a lower filter chamber 20*b* positioned on the downstream side of the filter 19 and gradually decreased in diameter from the upstream (upper end opening) side toward the downstream (lower end opening) side. The head flow channel 37 is formed continuously from the minimum diameter portion at the lower end (lower end opening) of the lower filter chamber 20*b* which is gradually decreased in diameter from the inner diameter of the upper end opening on the filter 19 side. That is, the filter chamber 20 is located on the upstream side of the head flow channel 37 which continues to the common ink chambers 33 (the pressure chambers 35) and has a larger diameter than other ink flow channels (liquid flow channels) such as the ink introduction channel 38 on the ink introduction needle 21 side and the head flow channel 37. The surface area of the upper end opening of the upper filter chamber 20*a* is matched with the surface area of the lower end opening of the ink introduction needle 21, and the surface area of the lower end opening is matched with the surface area of an effective filtering area of the filter 19 (the surface area of the filter 19 through which the ink can actually pass through) arranged immediately below. The surface area of the upper end opening of the lower filter chamber 20*b* is matched with the effective filtering area of the filter 19 arranged immediately above, and the surface area of the lower end opening is matched with the surface area of the upper end opening of the head flow channel 37. Therefore, the filter chamber 20 is configured to be able to allow smooth flow of ink and air bubbles from the ink introduction needle 21 side toward the head flow channel 37 via the filter 19. In this embodiment, the filter chamber is not arranged in the middle of the head flow channel 37 which communicates with the common ink chambers 33 and the pressure chambers 35 on the downstream side. Therefore, the filter chamber 20 formed with a liquid repellent area 44 described above is a filter chamber formed downstreammost position, that is, the most closest position to the pressure chamber 35, from among the filter chambers formed in the identical ink flow channel, which is the upstream side of the head flow channel 37 (pressure chamber 35). In the type in which a liquid storage member such as the ink cartridge 7 are provided on the side of the casing of the printer 1, and the ink is supplied to the recording head 3 side through the ink supply tube from the ink cartridge 7, there is a case in which a plurality of filter chambers are provided partway in a series of ink flow channels (liquid flow channel) extending from the ink cartridge 7 to the nozzle opening 14 of the recording head 3. In such a type as well, the liquid repellent area 44 is formed on the inner wall of the filter chamber which is formed at a position closest to the pressure chamber.

The filter 19 disposed in the interior of the filter chamber 20 has a function to filter the ink in the ink flow channel (liquid flow channel), and the flow channel resistance of the ink flow channel is reduced by securing a larger effective filtering area than the cross-sectional area of other ink flow channels. In this embodiment, the size of minute passage holes of the filter 19 is set to be able to remove foreign substances having a maximum external size of 5 to 16 μm from the ink in the ink flow channel. Therefore, this embodiment achieves not only reduction of the flow channel resistance of the filter 19 but also enhancement of the air bubble expellant efficiency for the air bubbles staying in the ink flow channel (filter chamber 20).

The introduction needle body 22 is attached to the introduction needle unit 15, for example, by ultrasonic welding, in a state in which the lower end opening of the upper filter chamber 20*a* of the filter chamber 20 opposes the filter 19. Accordingly, the lower end opening of the upper filter chamber 20*a* and the upper end opening of the lower filter chamber 20*b* communicate with each other in a liquid-tight state via the filter 19. That is, the ink introduction channel 38 of the introduction needle body 22 and the head flow channel 37 on the head case 16 side communicate with each other in a liquid-tight state. The ink introduction channel 38 and the head flow channel 37 function as the liquid flow channels in the embodiment of the invention.

There is a case where air breaks into the ink introduction channel 38 (ink flow channel), for example, when the ink introduction needle 21 of the introduction needle body 22 is inserted into and pulled out from the ink cartridge 7. In the filter chamber 20, minute air bubbles are combined together and gradually grows into a large amount of air bubbles A (see FIG. 7A). According to the embodiment of the invention, the air bubbles A are stored and retained in the upper filter chamber 20*a* of the filter chamber 20 in a state of floating upwardly (the upstream side) of the filter 19 by buoyancy acting on the air bubbles without passing through the filter 19 and moving toward the pressure chamber side at an ink flow rate during the normal recording operation (at the time when the ink drops are expelled) until the air bubbles A reach about a size that the lower portion reaches the filter 19, or about a size which does not close the filter chamber 20 (hereinafter, such size of the air bubbles is referred to as "allowable air bubble amount"). The printer 1 is configured in such a manner that the air bubbles A stored in the filter chamber 20 are expelled before it grows to a size which causes a problem, that is, before it grows to the allowable air bubble amount by performing the cleaning operation regularly with the capping mechanism 12. The cleaning operation for forcedly expelling the ink and air bubbles in the ink flow channel of the recording head 3 will be described below.

In the cleaning operation, as shown in FIGS. 7A to 7D, the pump unit 13 is activated in a state in which the cap member 12' is brought into tight contact with the nozzle formed surface to generate an ink flow at several times the flow rate in the normal recording operation in the ink flow channel (ink introduction channel 38) and cause the air bubbles A in the filter chamber 20 to flow together with the ink flow, so that the air bubbles A are pressed against the upper surface (upstream side) of the filter 19 and passed therethrough and moved toward the downstream side, and is expelled to the outside the head from the nozzle openings 14 through a series of the ink flow channels on the downstream side of the filter 19. When the cleaning operation is ended, the air bubbles which remain without having passed through the filter 19 during the cleaning operation suspend in the upper filter chamber 20*a* of the filter chamber 20 as remaining air bubbles B (see FIG. 7D). Suction conditions (sucking force, sucking time) of the pump unit 13 during the cleaning operation are set to conditions considering the repellent property of the air bubbles. From a viewpoint of preventing the air bubbles A in the filter chamber 20 from growing to a size which causes a problem such that the air bubbles A in the filter chamber 20 through the execution of the cleaning operation, the timing at which the cleaning operation is executed is preferably set to a range of period during which the air bubbles A grow from about a size which comes into contact with the inner wall of the upper filter chamber 20*a* of the filter chamber 20 to a size which is just before coming into contact with the filter 19 (that is, the allowable air bubble amount). In this embodiment, since the air bubbles A are pressed against the filter 19 by the ink flow during the cleaning operation, the ink flow channel (ink introduction channel 38) is clogged by the air bubbles A. The state in which the ink flow channel is clogged is intentionally generated in order to facilitate repellent of the air bubbles A during the cleaning operation. This point will be described later in detail.

As shown in FIG. 6, the filter chamber 20 in this embodiment includes the liquid repellent area 44 on the inner wall of the upper filter chamber 20*a* on the upstream side of the filter 19 circularly in the vicinity of the filter 19. The liquid repellent area 44 has a static contact angle with respect to ink (liquid) larger than that of the inner wall of the lower filter chamber 20*b* on the downstream side of the filter 19. More specifically, the inner wall of the upper filter chamber 20*a* is divided into the liquid repellent area 44 formed in the vicinity of the filter 19, that is, so as to surround the filter 19 by a predetermined width on the upstream side of the boundary between the filter 19 and the upper wall, and a non-liquid-repellent area 45 being arranged on the upstream side of the liquid repellent area 44 and having a statistic contact angle with respect to the ink (liquid) smaller than the liquid repellent area 44. That is, the area of the inner wall of the upper filter chamber 20*a* other than the liquid repellent area 44 is the non-liquid-repellent area 45. The term "in the vicinity of the filter 19" means a state of being in contact with the filter 19, or a state of keeping a slight gap with respect to the filter 19. The liquid repellent area 44 of this embodiment demonstrates a state which does not get wet with ink, that is, a state of repelling ink but adsorbing gas (air bubbles), having, for example, a static contact angle 100 to 115° with respect to pure water. The non-liquid-repellent area 45 demonstrates a state of getting wet with ink, having, for example, a static contact angle of 60 to 75° with respect to pure water. In addition, the ink flow channel other than the liquid repellent area 44 in this embodiment has the statistic contact angle with respect to the ink at the same or lower value than the non-liquid-repellent area 45. This is for making the ink flow channel get wet with ink more so as to prevent the air bubbles from being adhered to the interior of the ink flow channel and causing a problem as much as possible.

Figure 7A:
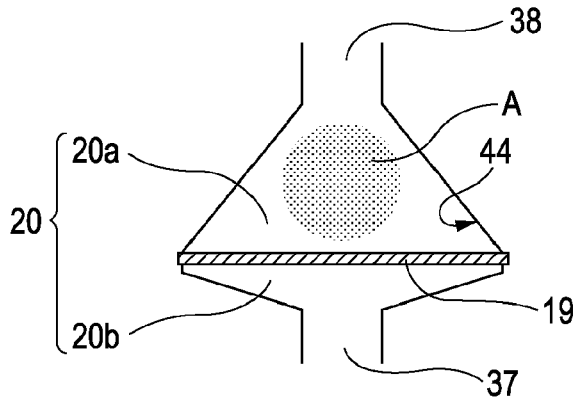
FIG. 7A to FIG. 7D are explanatory cross sections illustrating a cleaning operation according to another embodiment.
Figure 7B:
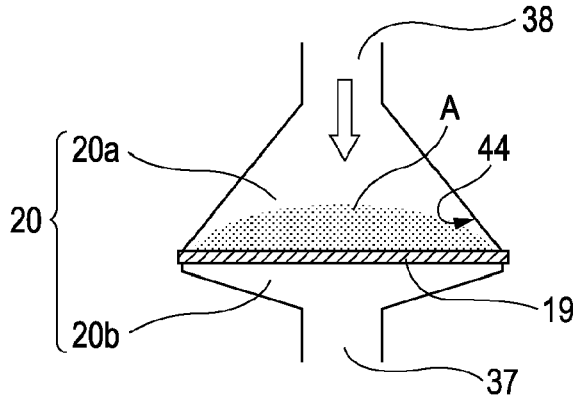
Figure 7C:
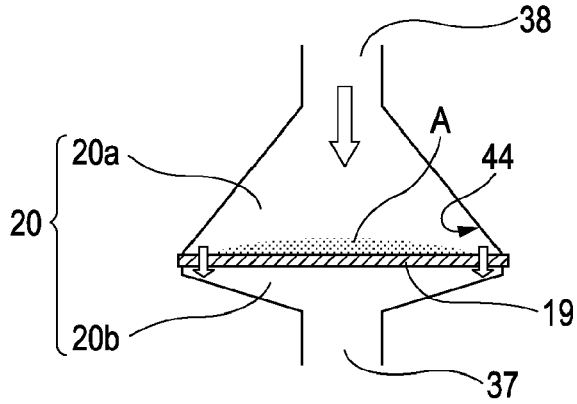
Figure 7D:
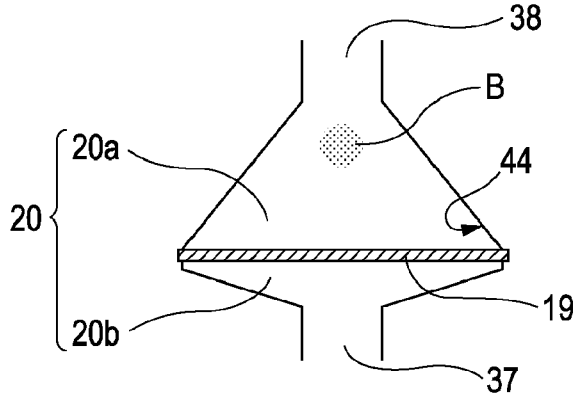

In this manner, through the formation of the liquid repellent area 44 having a static contact angle with respect to ink larger than that of the inner wall of the lower filter chamber 20*b* on the downstream side of the filter 19 on the inner wall of the upper filter chamber 20*a* of the filter chamber 20, the air bubbles A pressed against and hence spread over the upper surface (upstream side) of the filter 19 by the ink flow during the cleaning operation are adhered to the liquid repellent area 44 formed so as to surround the circumference of the filter 19 as shown in FIGS. 7A to 7D. This is because an adhesive force for repelling ink and causing gas such as the air bubbles to be adhered to the liquid repellent area 44 is generated by setting the static contact angle of the liquid repellent area 44 with respect to ink to a value larger (lower in wettability) than other areas (the inner wall of the lower filter chamber 20*b* or the non-liquid-repellent area 45). Therefore, the ink can hardly pass through the area between the inner wall of the filter chamber 20 and the air bubbles A, and the flattened air bubbles A cover the upper surface of the filter 19 in the state of adhering to the liquid repellent area 44 around the filter 19, so that the ink flow channel is closed temporarily (see FIG. 7B). Accordingly, a pressure difference between the upstream side and the downstream side is achieved with respect to the air bubbles A (filter 19). That is, the pressure on the downstream side with respect to the filter 19 is lowered in comparison with the pressure on the upstream side temporarily. When the pressure difference exceeding a certain level is reached, the air bubbles A can be flowed to the downstream side with great force using this pressure difference (FIG. 7C). Accordingly, the filter 19 allows easy passage of the air bubbles A, and hence the air bubbles A are repelled with high efficiency in a short time in comparison with the related art. In this sense, the one cleaning operation achieves not only repellent of a larger amount of air bubbles than in the related art, but also reduction of amount of ink consumption.

In this configuration, even when though the air bubbles A are drawn to the downstream side via the filter 19 and repelled therefrom by means of this pressure difference, all the air bubbles A cannot be repelled, and remaining air bubbles stay in the upper filter chamber 20*a* of the filter chamber 20 as the remaining air bubbles B. The reason is as follows. The air bubbles A which cover the upper surface of the filter 19 are repelled so that the thickness in the height direction and the width in the lateral direction are gradually reduced, so that the peripheral edge of the air bubbles A comes apart from the liquid repellent area 44 and hence a gap is formed therebetween. Therefore, the filter 19 cannot be covered almost completely due to the gap (a state of covering the effective filtering area of the filter 19 from 90 to 100%), and hence the ink flows to the downstream side through the peripheral edge of the air bubbles A. Consequently, the pressure difference between the upstream side and the downstream side of the filter 19 is reduced to a level smaller than a certain value, so that the air bubbles A cannot be drawn to the downstream side (FIG. 7C). In addition, since the air bubbles A come apart from the liquid repellent area 44, a resistance force against a buoyancy which acts on the air bubbles A (adhesive force with respect to the liquid repellent area 44) is lost, and simultaneously, the holding force of the ink flow acting on the air bubbles A is reduced as the capacity of the air bubbles A reduces causes the result that the air bubbles A cannot be retained on the upper surface of the filter 19. Consequently, the air bubbles A are floated by buoyancy and remains as the remaining air bubbles B which suspend in the upper filter chamber 20*a*.

Therefore, with the configuration according to the embodiment described above, the one cleaning operation allows a larger amount of air bubbles to be repelled than in the related art, and hence the remaining air bubbles B staying in the filter chamber 20 when the cleaning operation is ended may be reduced in comparison with the related art. For example, an experiment proved that the amount of the remaining air bubbles in the related art, which was about 30 $mm^3$, could be reduced to about 5 $mm^3$, which is ⅙ the related art, in the configuration of the embodiment of the invention. On the basis of the result of the experiment, a period which is needed for the remaining air bubbles B in the filter chamber 20 to grow to the allowable air bubble amount, for example, 40 $mm^3$ is a period which is needed to grow by 40−30=10 $mm^3$. In contrast, according to the embodiment, the period in question is a period needed for the remaining air bubbles to grow by 40−5=35 $mm^3$. That is, the period needed for the remaining air bubbles B in the filter chamber 20 to reach the allowable air bubble amount may be expanded to about 3.5 times the related art. In this sense, the intervals of execution of the cleaning operation may be set to a large value. Consequently, the frequency of execution of the cleaning operation may be reduced. Accordingly, consumption of the ink used for the cleaning operation is further reduced.

The inner wall of the upper filter chamber 20*a* according to this embodiment is divided into the liquid repellent area 44 formed in the vicinity of the filter 19 and the non-liquid-repellent area 45 being arranged on the upstream side of the liquid repellent area 44 and having a smaller static contact angle with respect to the ink than that of the liquid repellent area 44, and the liquid repellent area 44 is set to a range from ⅓ the distance from the lower end opening to the upper end opening of the upper filter chamber 20*a* (the height of the upper filter chamber 20*a*) to the filter, for example. It is for enhancing wettability of the inner wall of the upstream side (upper side) of the upper filter chamber 20*a* with respect to the ink to prevent easy adherence of small air bubbles on the inner wall of the upper side (upstream side) of the upper filter chamber 20*a*. It is because that when the small air bubbles are adhered to the upper inner wall of the upper filter chamber 20*a*, even through the flow rate in the ink flow channel is increased by the cleaning operation, the air bubbles cannot be pressed against the filter 19, so that the air bubbles cannot be repelled. In this case, the combination of the air bubbles adhered to the interior of the upper filter chamber 20*a* and the suspending remaining air bubbles B corresponds to the actual amount of remaining air bubbles, the amount of the remaining air bubbles in the filter chamber 20 increases. Consequently, the frequency of execution of the cleaning operation is increased. That is, through the division of the inner wall of the upper filter chamber 20*a* into the liquid repellent area 44 formed in the vicinity of the filter 19 and the non-liquid-repellent area 45 formed on the upstream side thereof, the air bubbles is liable to be adhered only in the vicinity of the filter 19, while the air bubbles are prevented from being adhered to the inner wall of the upper filter chamber 20*a* which is far apart from the filter 19, so that increase in the amount of remaining air bubbles in the filter chamber is prevented. Therefore, the period which is needed for the amount of the remaining air bubbles to reach the allowable air bubble amount is prevented from being shorter, so that the increase of the frequency of execution of the cleaning operation is prevented as much as possible. The range of the liquid repellent area 44 shown above is determined on the basis of the experiment. However, the invention is not limited to this range. That is, the range may be set as needed on the basis of conditions such as the flow channel resistance and the effective filtering area of the filter 19, the shape of the filter chamber 20 (height, inner diameter of the upper end opening, inner diameter of the lower end opening), and the flow rate of the ink flow during the cleaning operation. What is important is to determine the range of the liquid repellent area 44 to a value which allows the air bubbles pressed against the filter 19 during the cleaning operation to be adhered to the liquid repellent area 44 and close the ink flow channel and, simultaneously, prevent additional remaining air bubbles from being adhered on the liquid repellent area 44 by limiting the range of the liquid repellent area 44 to be extended on the upstream side where the air bubbles pressed against the filter 19 are not adhered.

The liquid repellent area 44 in this embodiment is formed by applying liquid repellent agent including fluorine-contained silicone or the like as a main component on the wall surface of the upper filter chamber 20*a*. Alternatively, the liquid repellent area 44 may be formed through film formation using, for example, an alkoxide process. The liquid repellent area 44 may also be formed through vapor deposition. Furthermore, the liquid repellent area 44 may be formed by using a separate member fabricated of a material such as fluorine-contained resin or silicon resin on the inner wall of the upper filter chamber 20*a*. What is important is to form the liquid repellent area 44 on the inner wall of the upper filter chamber 20*a* of the filter chamber 20 so that the static contact angle with respect to the ink is larger than the inner wall of the lower filter chamber 20*b* on the downstream side of the filter 19, and hence the invention is limited to the approaches shown above, and any approaches may be used for forming the liquid repellent area 44.

Another embodiment of the filter chamber will now be described.

In the above-described embodiment, description has been given about the example of the filter chamber 20 formed in the ink flow channel (ink introduction channel 38) which is positioned adjacently on the downstream side of the ink introduction needle 21 of the introduction needle body 22, and formed on the downstreammost side (close to the pressure chamber 35) from among the plurality of filter chambers formed in the same ink flow channel. However, the invention is not limited thereto. For example, the invention is applicable to a filter chamber having the smallest capacity from among the plurality of filter chambers formed in the same ink flow channel of the recording head 3. It is because the allowable air bubble amount is small in the filter chamber having the small capacity, and hence improvement of efficiency of air bubble repellent is necessary as described above. Preferably, it is applied to all the filter chambers formed in the ink flow channel in the recording head 3.

The recording head 3 as a kind of liquid ejecting head has been described thus far as an example. However, the invention is also applicable to other liquid ejecting heads having the liquid introduction needle. For example, the invention is also applicable to a color material ejecting head used for manufacturing color filters of liquid crystal display or the like, an electrode material ejecting head used for forming electrodes, for example, in an organic EL (Electro Luminescence) display and an FED (surface emission type display), and a biological organic substance ejecting head used for manufacturing biochips.

What is claimed is:

1. A liquid ejecting head which is capable of introducing liquid from a liquid storage member to a pressure chamber through a liquid flow channel and discharging the liquid in the pressure chamber from a nozzle opening as liquid drops by an operation of pressure generating means, comprising:

a filter chamber in the middle of the liquid flow channel, the filter chamber having a diameter larger than other portions of the liquid flow channel and having a filter disposed therein for filtering the liquid in the liquid flow channel, wherein the filter chamber includes an inner wall formed above the upstream side of the filter which includes a liquid repellent area, the liquid repellent area having a static contact angle with respect to liquid which is larger than that of the inner wall formed on the downstream side of the filter in the vicinity of the filter.

2. The liquid ejecting head according to claim 1, wherein the inner wall of the filter chamber on the upstream side of the filter is divided into the liquid repellent area formed in the vicinity of the filter and a non-liquid-repellent area being arranged on the upstream side of the liquid repellent area and having a static contact angle with respect to liquid smaller than that of the liquid repellent area.

3. The liquid ejecting head according to claim 1, wherein the filter chamber is a filter chamber formed on the upstream side of the pressure chamber at the closest position to the pressure chamber.

4. The liquid ejecting head according to claim 1, further comprising:

a liquid introducing needle for introducing liquid from the liquid storage member through a liquid introduction hole into the liquid flow channel, wherein the filter chamber is formed in the liquid flow channel adjacent to the liquid introduction needle on the downstream side.

5. The liquid ejecting head according to claim 1, wherein the filter chamber is a filter chamber having the smallest capacity from among a plurality of the filter chambers formed in the same liquid flow channel.

6. The liquid ejecting head according to claim 1, wherein the filter chamber corresponds to all the filter chambers formed in the liquid flow channel.

7. The liquid ejecting head according to claim 1, wherein the filter in the filter chamber is capable of removing foreign substances having a maximum external size of 5 to 16 μm from the liquid in the liquid flow channel.

8. The liquid ejecting head according to claim 1, wherein the liquid repellent area is formed by applying liquid repellent agency.

9. The liquid ejecting head according to claim 1, wherein the liquid repellent area is formed by film formation.

10. The liquid ejecting head according to claim 1, wherein the liquid repellent area is formed by vapor deposition.

11. The liquid ejecting head according to claim 1, wherein the liquid repellent area is formed by using liquid repellent material.

* * * * *